US011395509B1

(12) United States Patent
Wahidi

(10) Patent No.: US 11,395,509 B1
(45) Date of Patent: Jul. 26, 2022

(54) SMOKABLE CONE INSERT INCLUDING FLAVOR RELEASING MECHANISMS

(71) Applicant: Jawid Wahidi, Irvine, CA (US)

(72) Inventor: Jawid Wahidi, Irvine, CA (US)

( * ) Notice: Subject to any disclaimer, the term of this patent is extended or adjusted under 35 U.S.C. 154(b) by 0 days.

(21) Appl. No.: 17/497,291

(22) Filed: Oct. 8, 2021

Related U.S. Application Data

(60) Provisional application No. 63/163,277, filed on Mar. 19, 2021.

(51) Int. Cl.
*A24D 3/04* (2006.01)
*A24D 3/18* (2006.01)

(52) U.S. Cl.
CPC ..... *A24D 3/18* (2013.01); *A24D 3/048* (2013.01)

(58) Field of Classification Search
None
See application file for complete search history.

(56) References Cited

U.S. PATENT DOCUMENTS 2,167,170 A * 7/1939 Burns ..... A24D 1/045 131/331
2013/0140197 A1* 6/2013 Fiebelkorn ..... A24D 1/047 206/205
2020/0107574 A1* 4/2020 Inagaki ..... A24D 3/08

* cited by examiner

*Primary Examiner* — Dennis R Cordray
(74) *Attorney, Agent, or Firm* — Cohen IP Law Group, PC; Michael N. Cohen

(57) ABSTRACT

An insert for use with a smokable (e.g., such as a pre-rolled or empty cone) with one or more internal cavities for securing flavor releasing mechanism(s) (e.g., flavored "click balls") is provided. The insert with internal cavities may be provided as a standalone item for use in pre-rolling and/or hand rolling a cone or cigarette. The insert may include a section of smokable material such as paper including a horizontal aperture and vertical fold lines towards one end. The fold lines may be folded back and forth to form an accordion shaped cavity into which the flavor releasing mechanisms may be inserted and held secure. The insert may then be rolled into a tubular shape and coupled with a smokable to serve as the smokable's mouthpiece.

20 Claims, 9 Drawing Sheets

SMOKABLE CONE INSERT INCLUDING FLAVOR RELEASING MECHANISMS

CROSS-REFERENCE TO RELATED APPLICATIONS

This application claims the benefit under 35 U.S.C. § 119(e) of U.S. Provisional Patent Application Ser. No. 63/163,277, filed on Mar. 19, 2021, the entire contents of which are hereby fully incorporated herein by reference for all purposes.

FIELD OF THE INVENTION

The present invention relates to smokable pre-rolls, including smokable pre-rolls with embedded flavor releasing mechanisms.

BACKGROUND

Ready-to-smoke smokables come in many forms and shapes, ranging from cigarettes to pre-rolls (e.g., pre-rolled cones as shown in FIG. 1). For those who wish to form his/her own smokable, empty cones are available into which the user adds his/her own smokable materials. In either case, the smokable oftentimes includes an insert (such as a filter or crutch) that serves as a mouthpiece at one end of the smokable.

A new phenomenon is happening within the smokables industry involving the inclusion of flavor releasing mechanisms within the smokable insert. In many cases, the flavor releasing mechanisms include small spheres filled with a flavoring substance (also known as click balls) that are designed to be squeezed by the user to effectively explode and release the flavoring. However, if a smokable or empty cone does not include a flavoring mechanism, and the user wishes to add one, he/she must hollow out a space within the insert to add the mechanism. This often leads to flavoring mechanisms falling out of the smokable, not working properly, and other undesirable results.

Accordingly, there is a need for an insert that includes an easy to use cavity into which a user (or manufacturer) may insert one or more flavor releasing mechanisms to maximize his/her smoking experience.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

For the purposes of this specification, the terms below will mean the following.

Cigarette generally refers to a smokable comprising a thin cylinder of finely cut tobacco, cannabis, other types of leaves, flowers, herbs, and/or other smokable materials, rolled in paper for smoking.

Figure 1:
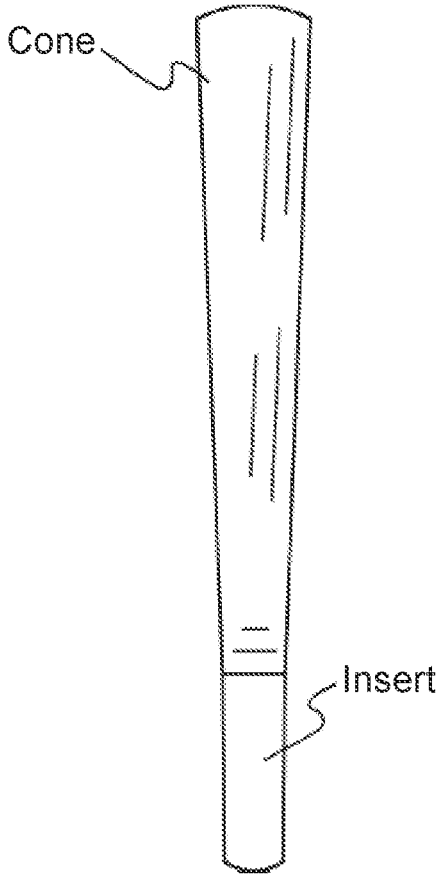
FIG. 1 (Prior Art)
FIG. 1 show aspects of a smokable cone (prior art)

Cone generally refers to a conical- or frustum-shaped cigarette (or "joint") wherein the shape flares from a smaller diameter proximal base to a larger diameter distal tip (see FIG. 1). Cones may typically comprise paper, hemp, palm leaves, rice, cotton cellulose, glycerin, and/or other suitable materials.

Pre-roll generally refers to a cigarette or cone that has been formed prior to its sale and is therefore consumer-ready (i.e., a consumer is not required to fill or otherwise form the smokable).

Empty cone refers to an empty cone into which a consumer may place smokable materials (e.g., tobacco, cannabis, etc.) to form a smokable cone.

Insert generally refers to a mouthpiece or tip coupled with a cone or cigarette (see FIG. 1) that acts to support the proximal end of the smokable (e.g., the end that is pressed against one's lips for smoking). An insert may include a "crutch" formed of thick paper, glass or other materials, a filter (e.g., a cotton filter), other types of inserts, and any combinations thereof. Inserts may be used with cigarettes, cones (pre-rolled, empty, etc.), rolling papers, and other types of smokable items.

In general, and according to exemplary embodiments hereof, an insert 10 with one or more internal cavities for securing flavor releasing mechanisms (e.g., flavored "click balls") and for use with a smokable item (e.g., a pre-roll cone, an empty cone, a pre-rolled or hand-rolled cigarette, etc.) is provided. In some embodiments, the insert with internal cavities is provided as a standalone item for use in pre-rolling and/or hand rolling a cone or cigarette. In this case, flavor releasing mechanisms may be inserted into the insert's internal cavities) and the insert may be coupled with the proximal end of a rolling paper to form the smokable item. In other embodiments, the insert includes (e.g., is coupled with) an empty cone (with or without flavor releasing mechanisms inserted) provided to the consumer. The consumer then may fill the empty cone with smokable materials to form a smokable cone wherein the insert is used as the cone's mouthpiece. Any combinations of these embodiments also are contemplated.

Figure 2:
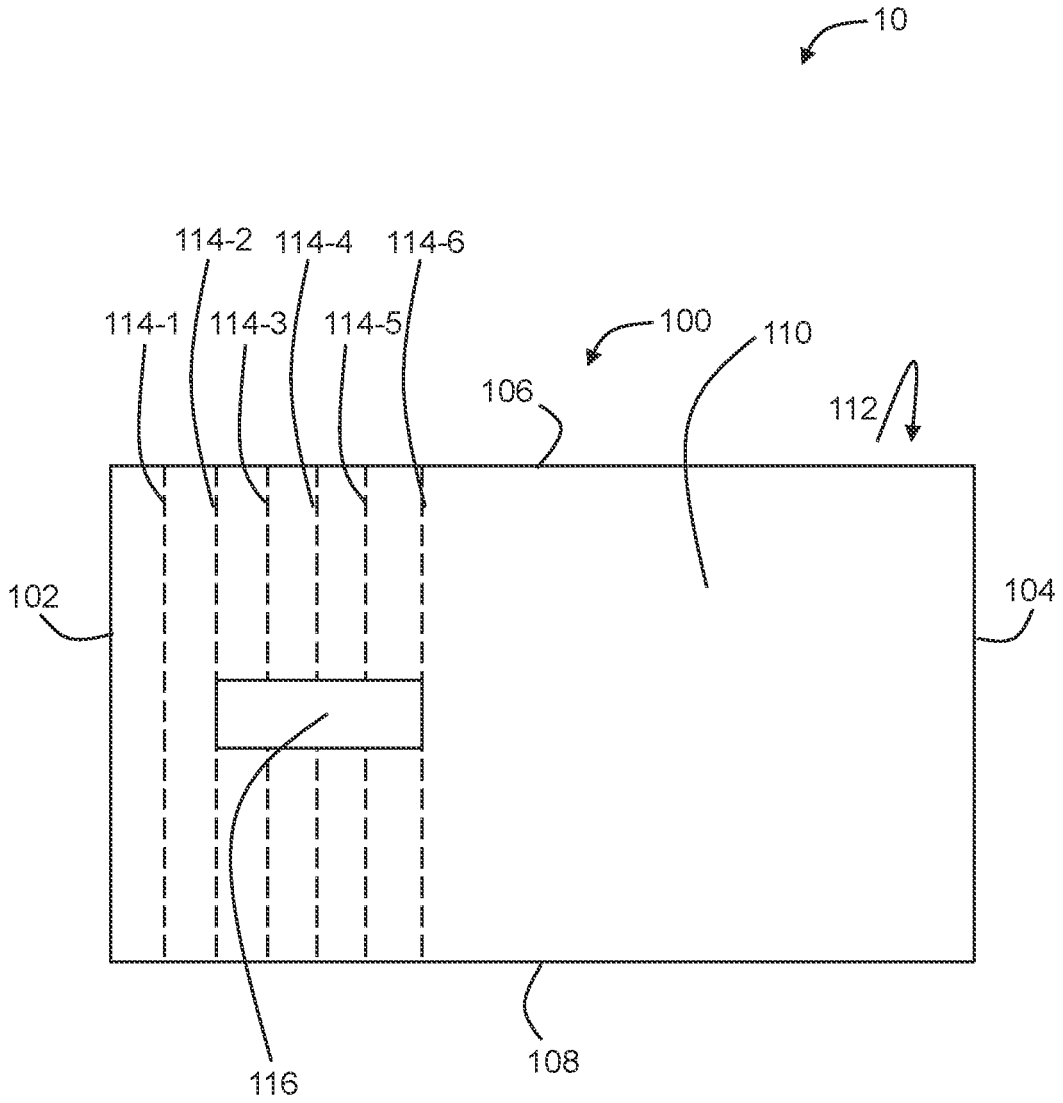
FIGS. 2-3 show aspects of a section for forming an insert according to exemplary embodiments hereof.

In one exemplary embodiment hereof as shown in FIG. 2, the insert 10 includes a section 100 that may be used to form the insert 10. The section 100 may comprise paper, cardboard, and/or other thin type of suitable material that is preferably non-toxic, flavorless, and burnable without adding any residual flavor to the smokable. In addition, the section 100 also is preferably porous so that it may disperse the flavoring released by the one or more flavor releasing mechanisms 200 evenly.

As shown, the section 100 includes a left side 102, a right side 104, a top side 106, a bottom side 108, a front 110, and a back 112. Once formed, as described in other sections, the insert 10 is adapted to receive, contain, and secure one or more flavor releasing mechanisms 200.

Figure 3:
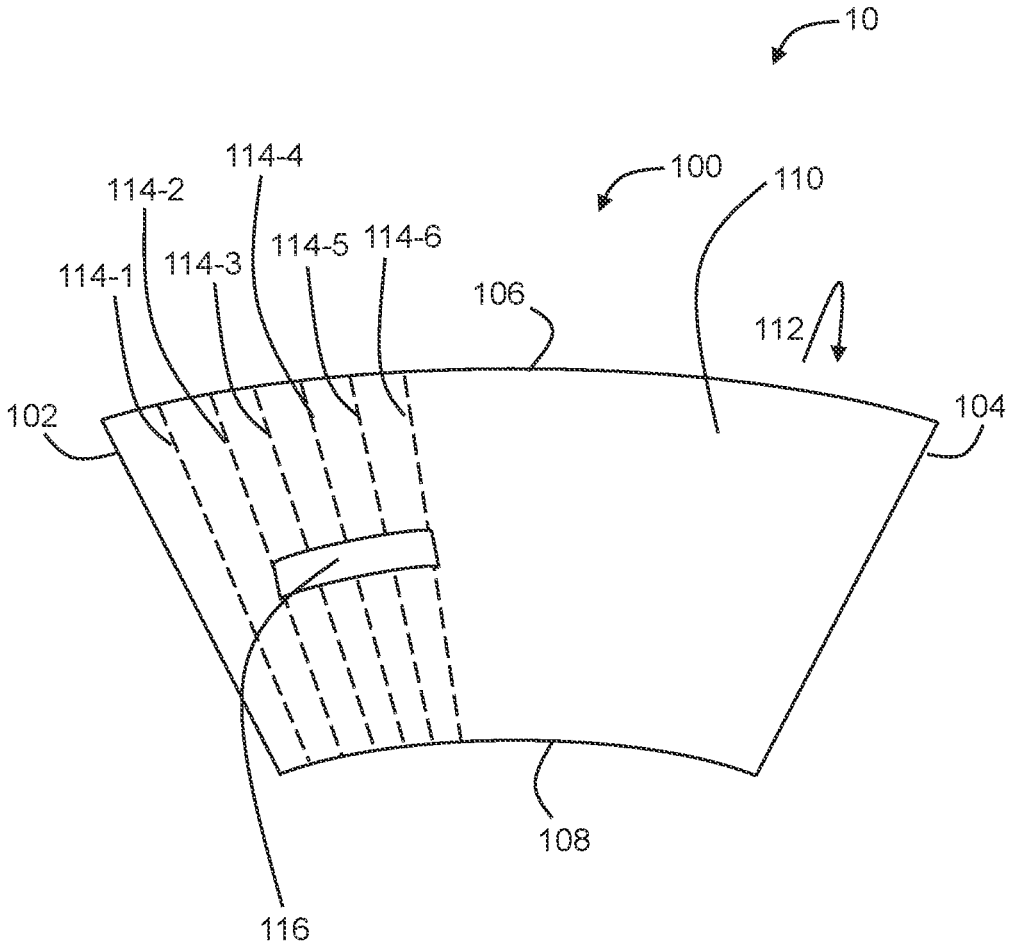

In some embodiments as shown in FIG. 2, the section 100 is generally rectangular in shape and may be used to form a generally cylindrical insert 10. In other embodiments as shown in FIG. 3, the section 100 is shaped as an opened frustrum wherein the shape includes a leftward slanting left side 102, and a rightward slanting right side 104, a convex top side 106, and a concave bottom side 110. In this embodiment, the section 100 is used to form a generally frustum-shaped insert 10. It is understood that the shapes described above are meant for demonstration and that the section 100 may be formed as any suitable shape.

In some embodiments as shown in FIGS. 2 and 3, the section 100 includes one or more fold lines 114-1, 114-2, 114-3, . . . **114-*n* (individually and collectively 114) that may be perforated, scribed, indicated by a line, or otherwise formed and/or identified to facilitate the easy folding of the section 100 along the fold lines 114 to generally form the insert 10. In other embodiments, the fold lines 114 may not be indicated directly on the section 100 but may be indicated elsewhere, e.g., in instructions (written, verbal, graphical, video, etc.) so that the user knows generally where to fold the section 100** as described herein.

In some embodiments, the fold lines 114 generally extend from the top side 106 to the bottom side 108 (or any portion thereof) and are preferably parallel, near parallel, or at a small offset angle with respect to one another. While FIGS. 2 and 3 depict a total of six fold lines 114, it is understood that any number of fold lines 114 may be provided. For example, the insert 10 may include one fold line 114, two fold lines 114, three fold lines 114, four fold lines 114, five fold lines 114, seven fold lines 114, and/or any other suitable number of fold lines 114.

In some embodiments as shown in FIGS. 2 and 3, the section 10 includes a cutout 116 (also referred to as an aperture) in the front 110 and extending to the back 112, and preferably in the area of the fold lines 114. In some embodiments, the cutout 116 includes a generally rectangular shape, however, other suitable shapes also may be used. For example, the cutout 116 may be proportionally shaped with respect to the section 100 (e.g., as an opened frustum as described above), shaped as an oval, pill-shaped, trapezoidal, etc. As will be described in other sections, the shape and size of the cutout 116 is preferably chosen to correspond to the shape and size of the flavor releasing mechanisms 200 that may be secured within the insert 10 once the insert 10 is formed.

In some embodiments as shown in FIGS. 2 and 3, the cutout 116 preferably extends from a location towards the left side 102 to a location towards the right side 106. In some embodiments, the cutout 116 extends from a fold line 114 towards the left side 102 to a fold line 114 towards the right side 104. For example, the cutout 116 may extend from the fold line 114-2 to the fold line 114-6 (as shown in FIGS. 2 and 3), from the fold line 114-1 to the fold line 114-5, or from any fold line 114 towards the left side 102 to any fold line 114 towards the right side 104. In addition, it is not required that the cutout 116 begin and/or terminate at a fold line 114, and the cutout 116 may extend from a first location between two fold lines 114 towards the left side 102 to a second location between two fold lines 114 towards the right side 104. The cutout 116 also may begin and terminate using any combination of the descriptions above.

In some embodiments as shown in FIGS. 2 and 3, the cutout 116 is generally centered between the top side 106 and the bottom side 108. However, the cutout 116 may be located at a position towards the top side 106 or in a position towards the bottom side 108. In some embodiments, the height of the cutout 116 is about 5%-50% the height of the section 100, and preferably about 10%-40% the height of the section 100, and more preferably about 15%-25% the height of the section 100, and more preferably about 20% the height of the section 100.

It is understood that the insert may include more than one cutout 116 (e.g., a second cutout 116 above or below a first cutout 116) that may be adapted to hold additional flavor releasing mechanisms 200. It is understood that any number of cutouts 116 may be included in any orientation and/or positional relationship with one another to hold any number of flavor releasing mechanisms 200.

Flavor Releasing Mechanisms 200

Figure 4:
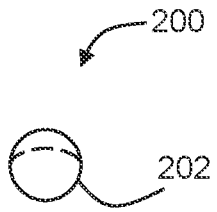
FIG. 4 show aspects of a flavor releasing mechanism according to exemplary embodiments hereof.

In some embodiments as shown in FIG. 4, the flavor releasing mechanisms 200 include any type of solid, liquid, or gas (and any combinations thereof) that may release one or more flavors when activated. The mechanisms 200 may be designed to be activated by heat (e.g., during smoking), by pressure (e.g., may be squeezed, pricked, or otherwise exploded, etc.), by other activation techniques, and by any combinations thereof.

In some embodiments, the flavor releasing mechanisms 200 include click balls 202 comprising a crushable spherical container with a flavoring substance inside. The click balls 202 may be adapted to generally burst (or otherwise open) when squeezed thereby releasing the flavoring substance. In this way, a user may squeeze a click ball 202 embedded within the insert 10 when a flavoring is desired during the smoking experience.

It is understood that any other type(s) and/or shapes of flavor releasing mechanisms 200 may be used with the insert 10, and that the scope of the insert 10 is not limited in any way by the type of flavor releasing mechanism(s) used.

Forming and Using the Insert

Figure 5:
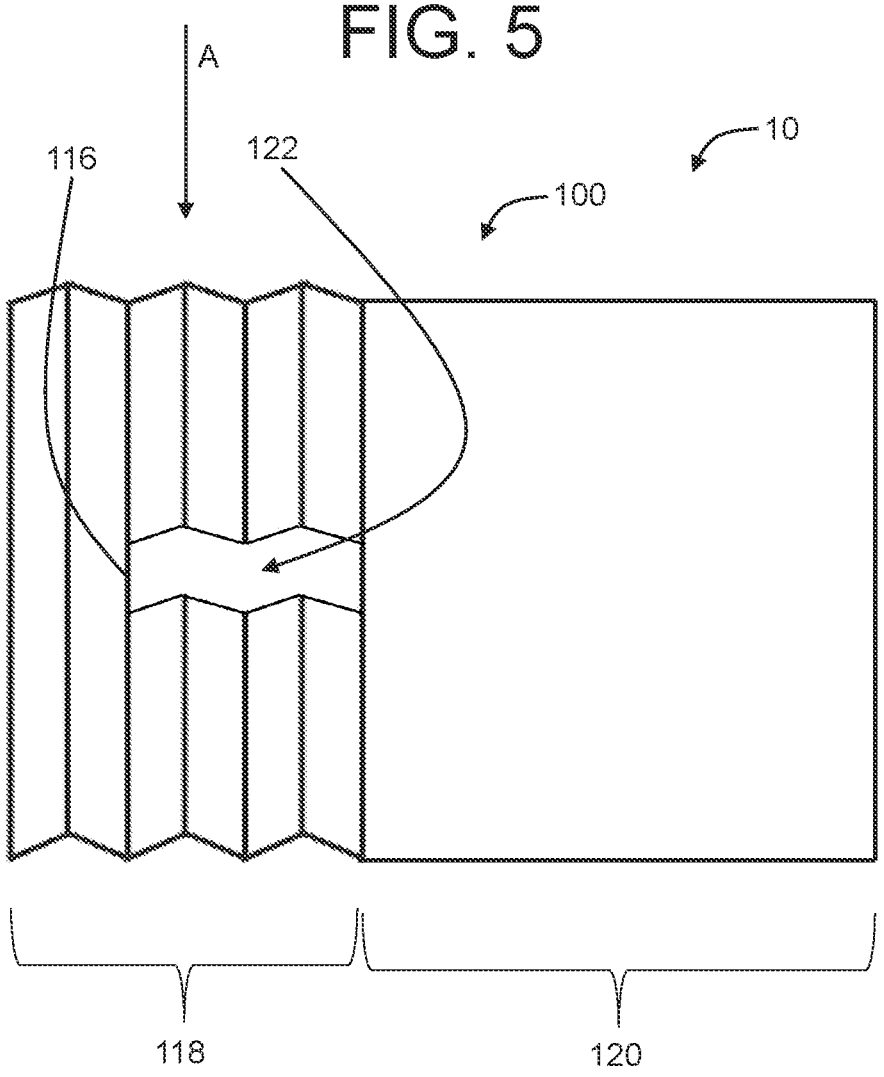
FIGS. 5-6 show aspects of a folded section for forming an insert according to exemplary embodiments hereof.
Figure 6:
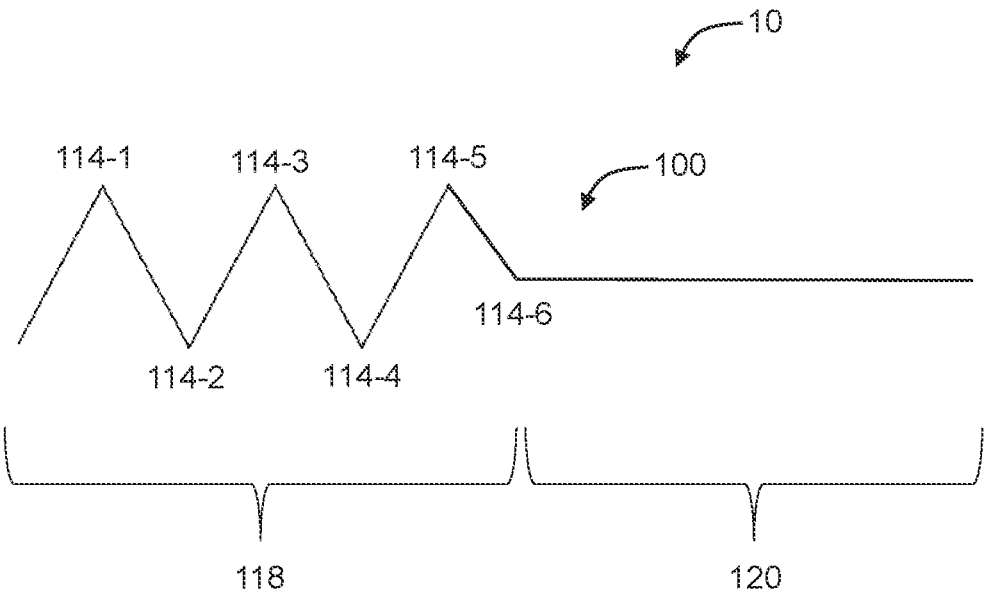

In some embodiments as shown in FIGS. 5-6, the insert 10 is formed by folding a section 100 back and forth along its fold lines 114 to create an accordioned portion 118 of the section 100 as shown. For example, the user may first fold the section 100 backward at a first fold line 114, and then fold the section 100 forward (substantially opposite the first backward direction) at a second fold line 114 adjacent the first fold line 114, and so forth. The remaining and unfolded portion of the section 100 preferably includes no fold lines 114 (although this is not required) and is referred to as the unfolded portion 120. FIG. 6 shows the folded section 100 of FIG. 5 from the perspective of arrow A.

In some embodiments, because the section 100 includes a cutout 116 in the area of the fold lines 114 as described in other sections, the accordioned portion 118 includes a cavity 122 formed by the accordioned cutout 116 in the accordioned portion 118.

Figure 7:
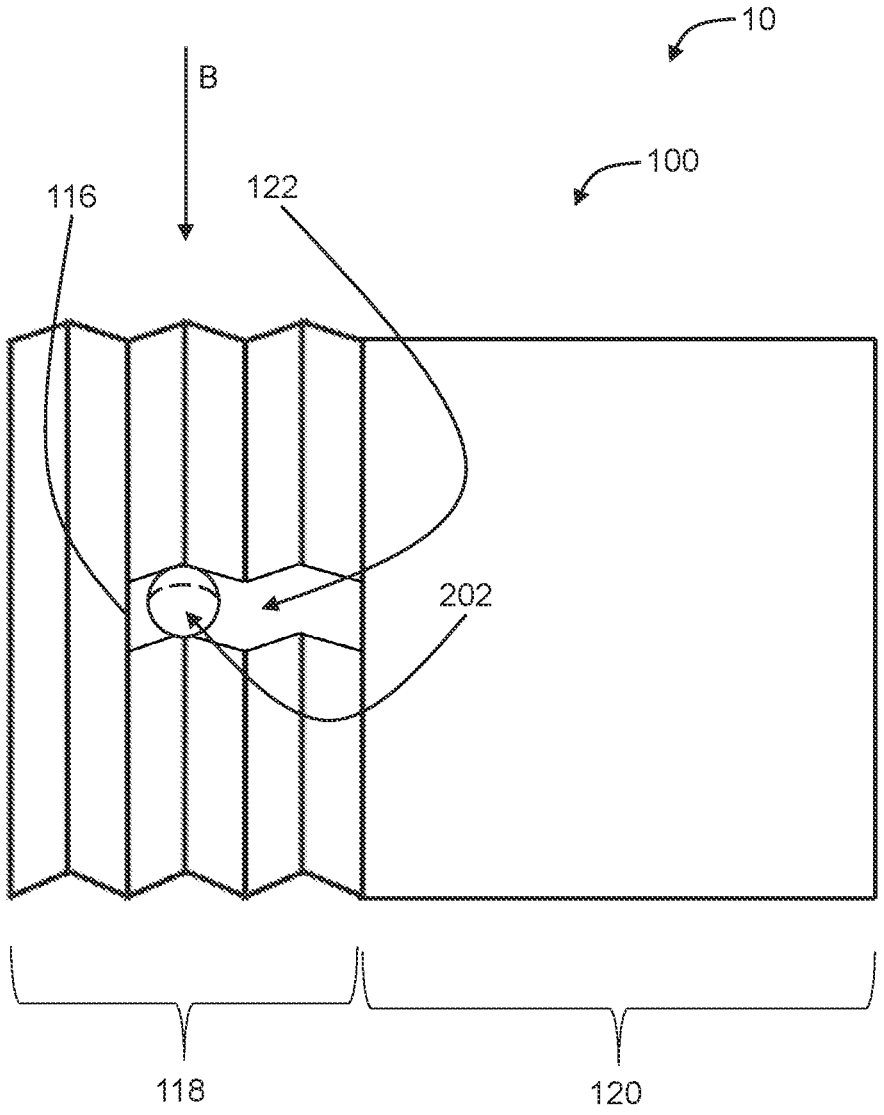
FIGS. 7-8 show aspects of a folded section including a flavor releasing mechanism for forming an insert according to exemplary embodiments hereof.

In some embodiments as shown in FIG. 6, a flavor releasing mechanism 200, such as but not limited to a click ball 202, is placed into the cavity 122 and held therein. FIG. 7 shows the flavor releasing mechanism 200 within the cavity 122 of FIG. 6 taken from the perspective of arrow B. As mentioned in other sections, it is preferable that the height of the cavity 122 (i.e., the height of the cutout 116, the dimensions between adjacent fold lines 114, and/or the overall width of the accordioned section 118 when pressed together as shown in FIG. 7) generally matches the height of the flavor releasing mechanism 200 (e.g., the diameter of a click ball 202) so that the flavor releasing mechanism 200 is held snug within the cavity 122.

Figure 8:
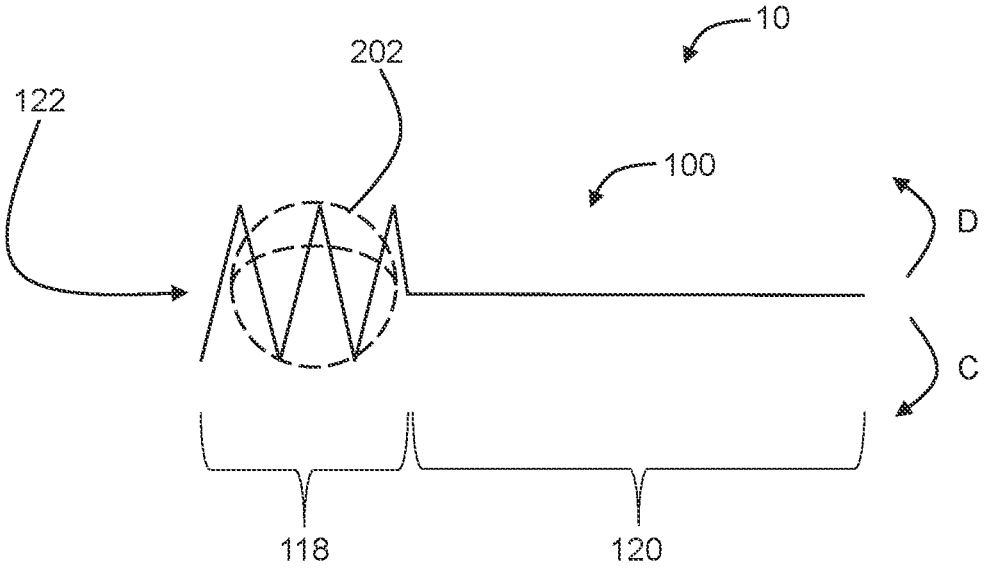
Figure 9:
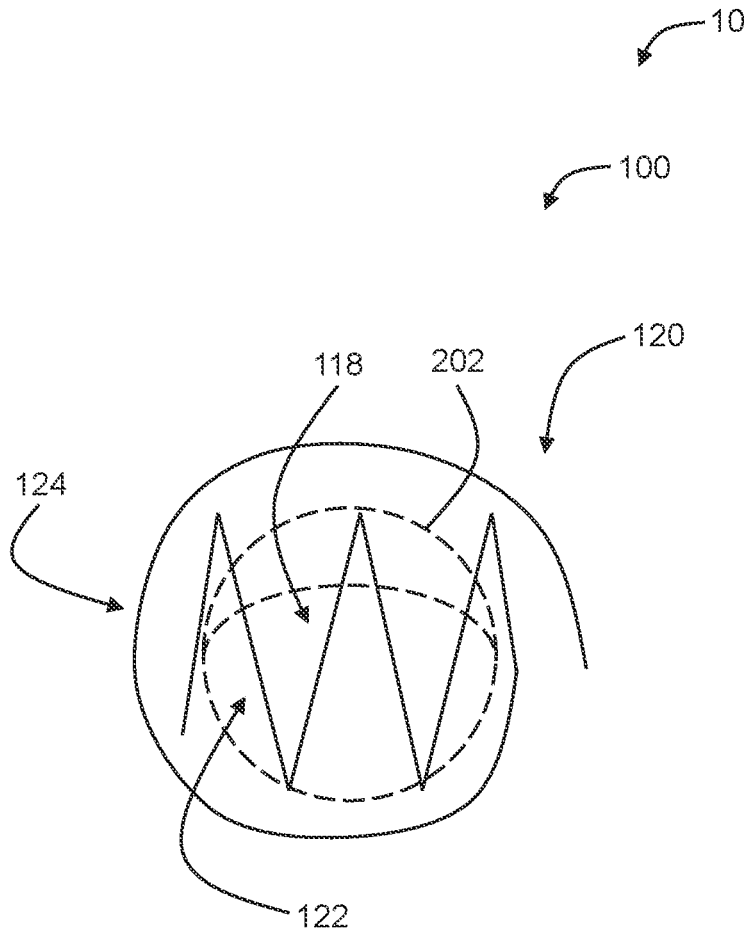
FIG. 9 show aspects of a generally formed insert including a flavor releasing mechanism according to exemplary embodiments hereof.

Next, as shown in FIG. 8, the unfolded portion 120 is wrapped around the accordioned portion 118 (either clockwise as depicted by the arrow C or counterclockwise as depicted by the arrow D) to form sidewalls 124 encircling the accordioned portion 118, the cavity 122, and the flavor releasing mechanism 200. This results in the configuration as shown in FIG. 9. Accordingly, it is preferable that the length of the unfolded portion 120 be sufficient to encircle the accordioned portion 120 at least once so that the sidewalls 124 fully encircle the accordioned portion 120 and the flavor releasing mechanism 200 held within the cavity 122. This may better ensure that the flavor releasing mechanism 200 is held securely within the cavity 122. However, in other embodiments, it may be sufficient for the unfolded portion 120 to only partially encircle the accordioned portion 118 thereby forming sidewalls 124 that may not fully encircle the accordioned portion 120 and/or the flavor releasing mechanism 200. In this case, it may be preferable that the sidewalls 124 at least encircle enough of the accordioned portion 118 to ensure that the flavor releasing mechanism 200 is held secure withing the cavity.

It is understood that the actions described above to form an insert 10 using a section 100 and a flavor releasing mechanism 200 are meant for demonstration and that the method of forming the insert 10 may include other actions not necessarily described, may not include all of the actions described, and/or any combinations thereof. For example, the insert 10 may be formed a first time without inserting the flavor releasing mechanism 200 into the cavity 122 in order to create an empty insert 10. The empty insert 10 may then be at least partially unfolded (e.g., the sidewalls 124 may be opened by unwrapping the unfolded portion 120) to expose the cavity 122, and to place the flavor releasing mechanism 200 into the cavity 122. The unfolded portion 120 may then be rewrapped around the accordioned portion 118 to create the sidewalls 124 and to secure the flavor releasing mechanism 200 therein.

Figure 10:
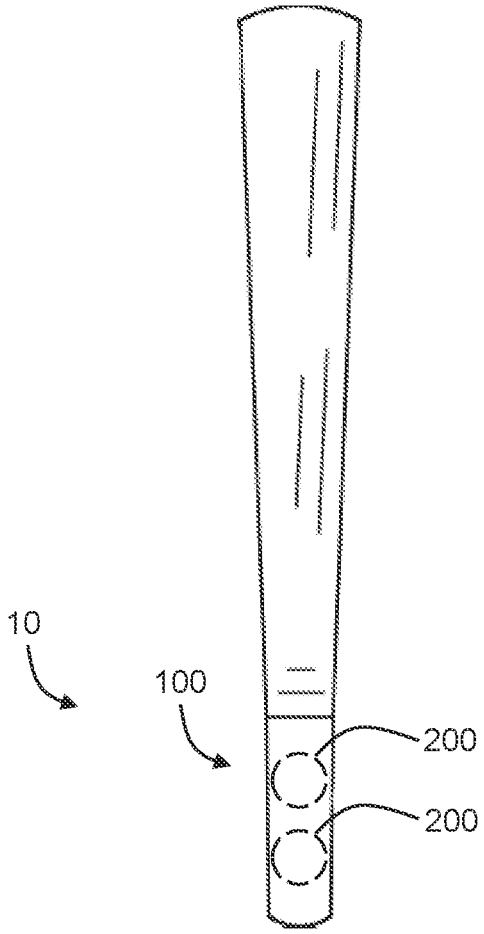
FIG. 10 shows aspects of a smokable cone configured with an insert according to exemplary embodiments hereof.

In some embodiments as shown in FIG. 10, once the insert 10 has been formed as described above or otherwise, it may be used as a tip, a mouthpiece, a crutch, a filter, as any type of base for a pre-roll, cone, empty cone, cigarette, other type of smokable, and for any combinations thereof as known in the art or otherwise. For example, in some embodiments, the insert 10 may be provided to manufacturers of pre-roll cones and/or cigarettes, of empty cones, etc. to be coupled to these types of products and then sold to consumers. In another example, the insert 10 may be coupled with a pre-roll cone and/or cigarette, and/or to an empty cone during its manufacturing and made for sale to consumers as the combination. In another example, the insert 10 may be sold directly to consumers such that the consumers themselves may couple the insert 10 with a rolling paper to form a cigarette, a cone, an empty cone, or other type of smokable item. It is understood that the examples described above are meant for demonstration and are non-limiting.

It is understood that any details and/or aspects of any embodiments described herein may be combined in any way to form additional embodiment(s) that also is within the scope of the system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. An insert for use as a mouthpiece to a smokable item and for securing at least one flavor releasing mechanism, the insert comprising:

a section of smokable material including a first side, a second side opposite the first side, a top side, a bottom side, a front, and a back; and a first aperture in the front of the section and extending to the back of the section, the first aperture located between the top side and the bottom side and extending to a point closer to the first side than it extends to the second side;

wherein the section is adapted to be folded in an area of the first aperture thereby forming a first cavity in the area of the first aperture, and wherein the first cavity is adapted to receive and secure at least one flavor releasing mechanism.

2. The insert of claim 1 further comprising:

at least one fold line located closer to the first side than to the second side and extending at least partially from the top side to the bottom side;

wherein a first portion of at least one of the at least one fold line is located above the first aperture and/or a second portion of the at least one of the at least one fold line is located below the first aperture.

3. The insert of claim 2 wherein at least one of the at least one fold line is perforated and/or indicated by a line.

4. The insert of claim 2 wherein the section is adapted to be folded at at least one of the at least one fold line thereby forming the first cavity in the area of the first aperture, and wherein the first cavity is adapted to receive and secure the at least one flavor releasing mechanism.

5. The insert of claim 4 wherein the section includes a portion adjacent at least one of the at least one fold line and adapted to be wrapped at least partially around the first cavity.

6. The insert of claim 4 wherein the section includes a first at least one fold line and a second at least one fold line, wherein the section is adapted to be folded in a first direction at the first fold line and in a second direction at the second fold line thereby forming the first cavity in the area of the first aperture.

7. The insert of claim 6 wherein the first direction is substantially opposite the second direction.

8. The insert of claim 2 wherein a total of the at least one fold line is selected from the group consisting of two, three, four, five, six, and seven fold lines.

9. The insert of claim 2 wherein the at least one fold line includes at least four sequential fold lines from the first side to the second side, and the aperture extends between a first and a third fold line.

10. The insert of claim 1 wherein the shape of the first aperture is selected from the group of rectangular, square, oval, and circular.

11. A method of creating an insert for use as a mouthpiece to a smokable item and for securing at least one flavor releasing mechanism, the method comprising:

(A) providing a smokable section of material including a first side, a second side opposite the first side, a top side, a bottom side, a front, and a back;

(B) forming a first aperture in the front of the section and extending to the back of the section, the first aperture located between the top side and the bottom side and extending to a point closer to the first side than it extends to the second side;

(C) folding the section in an area of the first aperture thereby forming a first cavity in the area of the first aperture, wherein the first cavity is adapted to receive and secure at least one flavor releasing mechanism.

12. The method of claim 11 further comprising:

(A)(1) forming at least one fold line located closer to the first side than to the second side and extending at least partially from the top side to the bottom side;

wherein a first portion of at least one of the at least one fold line is located above the first aperture and/or a second portion of the at least one of the at least one fold line is located below the first aperture.

13. The method of claim 12 wherein the forming at least one fold line includes perforating at least one of the at least one fold line and/or indicating at least one of the at least one fold line by a line.

14. The method of claim 12 wherein the folding in (C) includes folding the section at at least one of the at the at least one fold line.

15. The method of claim 14 further comprising;

(D) wrapping a portion adjacent at least one of the at least one fold line at least partially around the first cavity.

16. The method of claim 12 wherein the forming at least one fold line in (A)(1) includes forming a first at least one fold line and a second at least one fold line, and the folding in (C) includes folding the section in a first direction at the first fold line and in a second direction at the second fold line thereby forming the first cavity in the area of the first aperture.

17. The method of claim 12 wherein the forming at least one fold line in (A)(1) includes forming a first at least one fold line and a second at least one fold line, and the forming the first aperture in (B) includes forming the first aperture to extend between the first at least one fold line and the second at least one fold line.

18. The method of claim 12 wherein the forming at least one fold line in (A)(1) includes forming a total number of the at least one fold lines selected from the group consisting of two, three, four, five, six, and seven fold lines.

19. The method of claim 12 wherein the forming at least one fold line in (A)(1) includes forming a total of at least four sequential fold lines from the first side to the second side, and the forming a first aperture in (B) includes forming a first aperture that extends between a first and a third fold line.

20. The method of claim 12 wherein the forming a first aperture in (B) includes forming a first aperture in a shape chosen from rectangular, square, oval, and circular.

* * * * *